US010109383B1

(12) United States Patent
Pärnaste

(10) Patent No.: US 10,109,383 B1
(45) Date of Patent: Oct. 23, 2018

(54) TARGET ASSEMBLY AND NUCLIDE PRODUCTION SYSTEM

(71) Applicant: General Electric Company, Schenectady, NY (US)

(72) Inventor: Martin Pärnaste, Knivsta (SE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/677,129

(22) Filed: Aug. 15, 2017

(51) Int. Cl.
*G21G 1/00* (2006.01)
*G21G 1/04* (2006.01)
*H05H 6/00* (2006.01)

(52) U.S. Cl.
CPC ..... *G21G 1/0005* (2013.01)

(58) Field of Classification Search
CPC .. G21G 1/10; G21G 1/00; G21G 1/04; G21G 2001/0015; G21G 2001/0021; H05H 6/00; H05H 2277/116; H05H 13/005; H05H 2007/008; H05H 7/001; H05H 7/04; G21K 5/08; G21K 1/10; G21K 1/14
USPC ..... 376/156, 195, 190, 194, 202, 151, 245, 376/192, 201, 342, 361; 250/492.1, 428, 250/429, 432 R, 433, 493.1, 496.1
See application file for complete search history.

(56) References Cited

U.S. PATENT DOCUMENTS 3,981,769 A * 9/1976 Winchell ..... C01B 7/20 376/201
5,987,087 A * 11/1999 Zhuikov ..... G21G 1/10 376/190
6,845,137 B2 * 1/2005 Ruth ..... G21G 1/10 376/156
8,288,736 B2 * 10/2012 Amelia ..... G21G 1/00 250/428
9,686,851 B2 * 6/2017 Nutt ..... H05H 6/00
9,894,746 B2 * 2/2018 Norling ..... H05H 6/00
2005/0061994 A1 * 3/2005 Amini ..... H05H 6/00 250/492.1
2009/0052628 A1 * 2/2009 Wilson ..... G21G 1/10 378/143
2009/0090875 A1 * 4/2009 Gelbart ..... G21G 1/04 250/492.1

(Continued)

OTHER PUBLICATIONS

Mochizuki et al., "Measurement of the Induced Radionuclides in Production of Radiopharmaceuticals for Positron Emission Tomography (PET)" Journal of Nuclear Science and Technology; vol. 43, No. 4; 2006; pp. 348-353.

(Continued)

*Primary Examiner* — David A Vanore
(74) *Attorney, Agent, or Firm* — Dean D. Small; The Small Patent Law Group, LLC

(57) ABSTRACT

Target assembly for an isotope production system. The target assembly includes a target body having a production chamber and a beam cavity that is adjacent to the production chamber. The production chamber is configured to hold a target material. The beam cavity is configured to receive a particle beam that is incident on the production chamber. The target assembly also includes a target foil positioned to separate the beam cavity and the production chamber. The target foil has a side that is exposed to the production chamber such that the target foil is in contact with the target material during isotope production. The target foil includes a material layer having a nickel-based superalloy composition.

20 Claims, 9 Drawing Sheets

(56) References Cited

U.S. PATENT DOCUMENTS

| | | | | |
|---|---|---|---|---|
| 2010/0278293 | A1* | 11/2010 | Stokely | G21G 1/10 376/151 |
| 2011/0255646 | A1* | 10/2011 | Eriksson | H05H 6/00 376/151 |
| 2017/0004898 | A1* | 1/2017 | Parnaste | G21G 1/10 |
| 2017/0236608 | A1* | 8/2017 | Parnaste | H05H 7/001 376/190 |
| 2017/0367170 | A1* | 12/2017 | Parnaste | H05H 6/00 |

OTHER PUBLICATIONS

Guillaume et al., "Recommendations for Fluorine-18 Production" International Journal of Radiation Applications and Instrumentation. Part A. Applied Radiation and Isotopes 42.8 (1991): pp. 749-762.

Galiano et al., "The Cyclotron Production of Carrier-Free 77BR via the 79Br(p,3n)77Kr→77Br Reaction using a liquid Target and On-Line Education" Applied radiation and isotopes 49.1-2 (1998): pp. 105-111.

Hughey et al., "Design Considerations for Foil Windows for PET Radioisotope Target" Targetry 91 (1992): pp. 11-18.

Avila-Rodriguez et al., Edmonton PET Centre, 3 pages.

Gagnon et al., "A Comparison of Nb, Pt, Ta, Ti, Zr, and ZrO2-sputtered Havar Foils for the High-Power Cyclotron Production of Reactive [18F]F" Proceedings of the 13th International Workshop on Targetry and Target Chemistry. 2010; 2 pages.

Ferguson et al., "Measurement of Long Lived Radioactive Impurities Retained in the Disposable Cassettes on the Tracerlab MX system during the Productions of [18F}FDG" Applied Radiation and Isotopes 69.10 (2011): 5 pages.

Wilson et al., "Niobium sputtered Harvar Foils for the High-power production of reactive [18F]Fluoride by Proton Irradiation of [180]H20 Targets" Applied radiation and isotopes 66.5 (2008): pp. 565-570.

* cited by examiner

Compositions of Material Layers (wt %)

| Alloy | Ni[a] | Co | Fe | Cr | Mo | W | Mn | Si | Cb | Al | Ti | C | B | Zr | Cu | P | S | Others |
|---|---|---|---|---|---|---|---|---|---|---|---|---|---|---|---|---|---|---|
| 1 | 75 | 2* | 3 | 16 | 0.5* | 0.5* | 0.5* | 0.2* | 0.15* | 4.5 | 0.5* | 0.04 | 0.01* | 0.1* | - | - | - | Y-0.01 |
| 2 | 70[b] | 1* | 8 | 16 | - | - | 0.35* | 0.35* | 1[c] | 0.8 | 2.5 | 0.08* | - | - | 0.5* | - | - | - |
| 3 | 65 | 1* | 2* | 8 | 25 | - | 0.8* | 0.8* | - | 0.5* | - | 0.03* | 0.006* | - | 0.5* | - | - | - |
| 4 | 58 | 13.5 | 2* | 19 | 4.3 | - | 0.1* | 0.15* | - | 1.5 | 3 | 0.08 | 0.006* | 0.05 | 0.1* | - | - | - |
| 5 | 58 | 14.4 | - | 16 | 3 | 1.2 | - | - | - | 2.5 | 4.9 | 0.01 | 0.015 | 0.03 | - | - | - | - |
| 6 | 57 | 10 | 1.5* | 20 | 8.5 | - | 0.3* | 0.15* | - | 1.5 | 2.1 | 0.06 | 0.005* | - | - | - | - | - |
| 7 | 57 | 15 | 0.5* | 16 | 3 | 1.25 | 0.2* | 0.2* | - | 2.5 | 5 | 0.02* | 0.015 | 0.04 | - | 0.01* | 0.002* | - |
| 8 | 54 | 11 | 2* | 19 | 10 | - | 0.2* | 0.2* | - | 1.7 | 3.2 | 0.07* | 0.006 | 0.04 | - | 0.01* | 0.002* | - |
| 9 | 52 | 20 | 0.7* | 20 | 6 | - | 0.4 | 0.2 | - | 0.6* | 2.4* | 0.06 | 0.005* | 0.04* | 0.2* | - | - | (Al+Ti)-2.6 |
| 10 | 52 | 1* | 19 | 18 | 3 | - | 0.35* | 0.35* | 5[c] | 0.5 | 0.9 | 0.05 | - | 0.004 | 0.1* | - | - | - |
| 11 | 52 | 11 | 5* | 19 | 10 | - | 0.1* | 0.5* | - | 1.5 | 3.1 | 0.09 | 0.006 | 0.07* | - | - | - | - |
| 12 | 47 | 2* | 27.5 | 20 | 0.5* | 0.5* | 0.5* | 0.3 | 0.15* | 3.8 | 0.3 | 0.05 | 0.004* | 0.025* | - | - | - | - |
| 13 | 74 | - | - | 12.5 | 4.2 | - | - | - | 2 | 6.1 | 0.8 | 0.12 | 0.012 | 0.1 | - | - | - | - |
| 14 | 61 | 9 | - | 12.4 | 1.9 | 3.8 | - | - | - | 3.1 | 4.5 | 0.12 | 0.02 | 0.1 | - | - | - | - |
| 15 | 50 | 20 | - | 15.5 | - | 3 | - | - | 2 | 2.8 | 4.3 | 0.15 | 0.015 | 0.05 | - | - | - | - |
| 16 | 60 | 9.5 | - | 14 | 4 | 4 | - | - | - | 3 | 5 | 0.17 | 0.015 | 0.03 | - | - | - | - |
| 17 | 67 | - | 1 | 15.5 | 14.5 | - | 0.5 | 0.4 | - | 0.2 | - | 0.02m | 0.009 | - | - | - | - | - |
| 18 | 67 | - | - | 30 | - | - | 0.3 | 0.3 | - | 0.9 | 1.8 | 0.03 | 0.003 | 0.06 | - | - | - | - |

[a]As balance [b]Minimum [c]Cb+Ta *Maximum

Fig. 6

TARGET ASSEMBLY AND NUCLIDE PRODUCTION SYSTEM

BACKGROUND

The subject matter disclosed herein relates generally to nuclide production systems, and more particularly to a nuclide production system that directs a particle beam through a target foil and into a liquid or gas material.

Radionuclides (also sometimes referred to as radioisotopes) have several applications in medical therapy, imaging, and research, as well as other applications that are not medically related. Systems that produce radionuclides typically include a particle accelerator, such as a cyclotron, that accelerates a beam of charged particles (e.g., H− ions) and directs the beam into a target material to generate the isotopes. The cyclotron is a complex system that uses electrical and magnetic fields to accelerate and guide the charged particles along a predetermined orbit within an evacuated acceleration chamber. When the particles reach an outer portion of the orbit, the charged particles form a particle beam that is directed toward a target assembly that holds the target material for isotope production.

The target material, which is typically a liquid, gas, or solid, is contained within a chamber of the target assembly. The target assembly forms a beam passage that receives the particle beam and permits the particle beam to be incident on the target material in the chamber. To contain the target material within the chamber, the beam passage is separated from the chamber by a foil (referred to herein as a "target foil"). A target foil may be a single material composition or two or more layers (e.g. metal sheet coated with another layer). In some cases, multiple discrete sheets may be stacked side-by-side and held together during operation. More specifically, the production chamber may be defined by a void within a target body. The target foil covers the void on one side and a section of the target assembly may cover the opposite side of the void to define the production chamber therebetween. The particle beam passes through the target foil and is incident upon the target material within the production chamber. The target foil experiences an elevated temperature from thermal energy provided by the particle beam.

In many cases, a front foil (sometimes referred to as a "degrader foil" or "vacuum foil") may be used. The particle beam intersects the front foil prior to intersecting the target foil. The front foil reduces the energy of the particle beam and separates the target assembly from the vacuum of the cyclotron. Although a front foil is frequently used in nuclide production systems, the front foil is not required and a target foil may be used without a front foil.

Target foils for gas and liquid targets also experience an elevated pressure along the side of the target foil that borders the production chamber. Target foils may also experience a corrosive and oxidizing environment due to contact with the target material. The elevated temperatures and pressures cause stress that renders the target foil vulnerable to rupture, melting, or other damage. Target foils may also contaminate the target media when the ions from the target foil are absorbed by the target material.

The most common target foil used today in commercial cyclotrons, especially those that are designed to produce $^{18}F$, and in many cases $^{11}C$, are Havar® foils. Havar® is an alloy that includes cobalt (42.0 wt %), chromium (19.5 wt %), nickel (12.7 wt %), tungsten (2.7 wt %), molybdenum (2.2 wt %), manganese (1.6 wt %), carbon (0.2 wt %), and iron (balance). Havar® foils have a high tensile strength at elevated temperatures and a thermal conductivity that makes the foils suitable for isotope production. Havar® foils, however, become increasingly radioactive with use, and furthermore, are associated with both chemical and radioactive impurities within the target material. These radioactive impurities can include $^{96}Tc$, $^{51}Cr$, $^{58}Co$, $^{57}Co$, $^{56}Co$, $^{52}Mn$, among others.

Attempts have been made to reduce the amount of impurities within the target material. For example, a niobium (or other refractory metal) layer may be deposited along the surface of the Havar® foil that contacts the target material. Such composite foils, however, can be expensive and may have other drawbacks. Other potential target foils, such as copper, aluminum, or titanium foils, have one or more undesirable qualities that render the foil impractical or less cost-effective for commercial use.

BRIEF DESCRIPTION

In an embodiment, a target assembly for an isotope production system is provided. The target assembly includes a target body having a production chamber and a beam cavity that is adjacent to the production chamber. The production chamber is configured to hold a target material. The beam cavity is configured to receive a particle beam that is incident on the production chamber. The target assembly also includes a target foil positioned to separate the beam cavity and the production chamber. The target foil has a side that is exposed to the production chamber such that the target foil is in contact with the target material during isotope production. The target foil includes a material layer that has a nickel-based superalloy composition.

In some aspects, the nickel-based superalloy composition includes nickel (75 wt %), cobalt (2 wt %), iron (3 wt %), chromium (16 wt %), molybdenum (0.5 wt %), tungsten (0.5 wt %), manganese (0.5 wt %), silicon (0.2 wt %), niobium (0.15 wt %), aluminum (4.5 wt %), titanium (0.5 wt %), carbon (0.04 wt %), boron (0.01 wt %), and zirconium (0.1 wt %).

In some aspects, the nickel-based superalloy composition includes at least 40 wt % nickel and a sum of percent weights for aluminum and titanium that is at most 10 wt %. Optionally, the nickel-based superalloy composition includes at least one of cobalt having a percent weight between 10 wt % and 20 wt % or chromium having a percent weight between 10 wt % and 20 wt %.

In some aspects, the target foil includes a nickel-based superalloy layer and the target foil also includes a secondary layer that is stacked with respect to the nickel-based superalloy layer. The secondary layer is positioned between the nickel-based superalloy layer and the production chamber and exposed to the production chamber such that the target material is in contact with the secondary layer during isotope production. Optionally, the secondary layer is configured to reduce chemical contaminants and long-lived radionuclides contaminants. Optionally, the secondary layer includes refractory or platinum-group metals or alloys.

Optionally, the target foil has a thickness that is between 10 and 50 micrometers. The target foil may be a single sheet having multiple bonded layers. Alternatively, the target foil may include multiple discrete sheets stacked side-by-side.

In an embodiment, an isotope production system is provided that includes a particle accelerator configured to generate a particle beam and a target assembly including a target body having a production chamber and a beam cavity that is adjacent to the production chamber. The production chamber is configured to hold a target fluid. The beam cavity opens to an exterior of the target body and is configured to receive a particle beam that is incident on the production chamber. The target assembly also includes a target foil positioned to separate the beam cavity and the production chamber. The target foil has a side that is exposed to the production chamber such that the target material is in contact with the target foil during isotope production. The target foil includes a material layer having a nickel-based superalloy composition.

In some aspects, the target foil includes a nickel-based superalloy layer that comprises nickel (75 wt %), cobalt (2 wt %), iron (3 wt %), chromium (16 wt %), molybdenum (0.5 wt %), tungsten (0.5 wt %), manganese (0.5 wt %), silicon (0.2 wt %), niobium (0.15 wt %), aluminum (4.5 wt %), titanium (0.5 wt %), carbon (0.04 wt %), boron (0.01 wt %), and zirconium (0.1 wt %).

In some aspects, the nickel-based superalloy composition includes at least 40 wt % nickel and a sum of percent weights for aluminum and titanium is at most 10 wt %. Optionally, the nickel-based superalloy composition includes at least one of cobalt having a percent weight between 10 wt % and 20 wt % or chromium having a percent weight between 10 wt % and 20 wt %.

In some aspects, the target foil also includes a secondary layer that is stacked with respect to the nickel-based superalloy layer. The secondary layer may be positioned between the nickel-based superalloy layer and the production chamber and exposed to the production chamber such that the target material is in contact with the secondary layer during isotope production. Optionally, the secondary layer is configured to reduce chemical contaminants and long-lived radionuclides contaminants. Optionally, the secondary layer comprises refractory or platinum-group metals or alloys.

In an embodiment, a method of generating radionuclides is provided. The method includes providing a target material into a production chamber of a target assembly. The target assembly has a production chamber and a beam cavity that is adjacent to the production chamber. The production chamber is configured to hold a target fluid. The beam cavity is configured to receive a particle beam that is incident on the production chamber. The target assembly also includes a target foil positioned to separate the beam cavity and the production chamber. The target foil has a side that is exposed to the production chamber such that the target material is in contact with the target foil during isotope production, wherein the target foil includes a material layer having a nickel-based superalloy composition. The method also includes directing the particle beam onto the target material. The particle beam passing through the target foil to be incident on the target material.

In some aspects, the target material is a gas material for the production of $^{11}C$ via the $^{14}N(p,a)^{11}C$ reaction. The target foil is exposed to the gas material such that the gas material is in contact with the target foil during isotope production. A side of the target foil that is in contact with the gas material has essentially no carbon.

In some aspects, the target material includes a liquid or gas material. The target foil is exposed to the liquid or gas material such that the liquid or gas material is in contact with the target foil during isotope production.

Optionally, the beam current of the system is at least 100 μA.

In some aspects, the nickel-based superalloy composition includes at least 40 wt % nickel and also comprises aluminum, titanium and at least one of cobalt or chromium, wherein a sum of percent weights of the aluminum and the titanium is at most 10 wt %, wherein the nickel-based superalloy composition also includes at least one of cobalt having a percent weight between 10 wt % and 20 wt % or chromium having a percent weight between 10 wt % and 20 wt %.

In some aspects, the target foil is a legacy foil. The method further includes replacing the legacy foil with the target foil having the material layer with the nickel-based superalloy composition and controlling operation of the cyclotron to increase a beam current.

BRIEF DESCRIPTION OF THE DRAWINGS

FIG. 6 is a table listing compositions that may be used for one or more layers of a target foil in accordance with an embodiment. Values are listed in percent weight.

DETAILED DESCRIPTION

Figure 1:
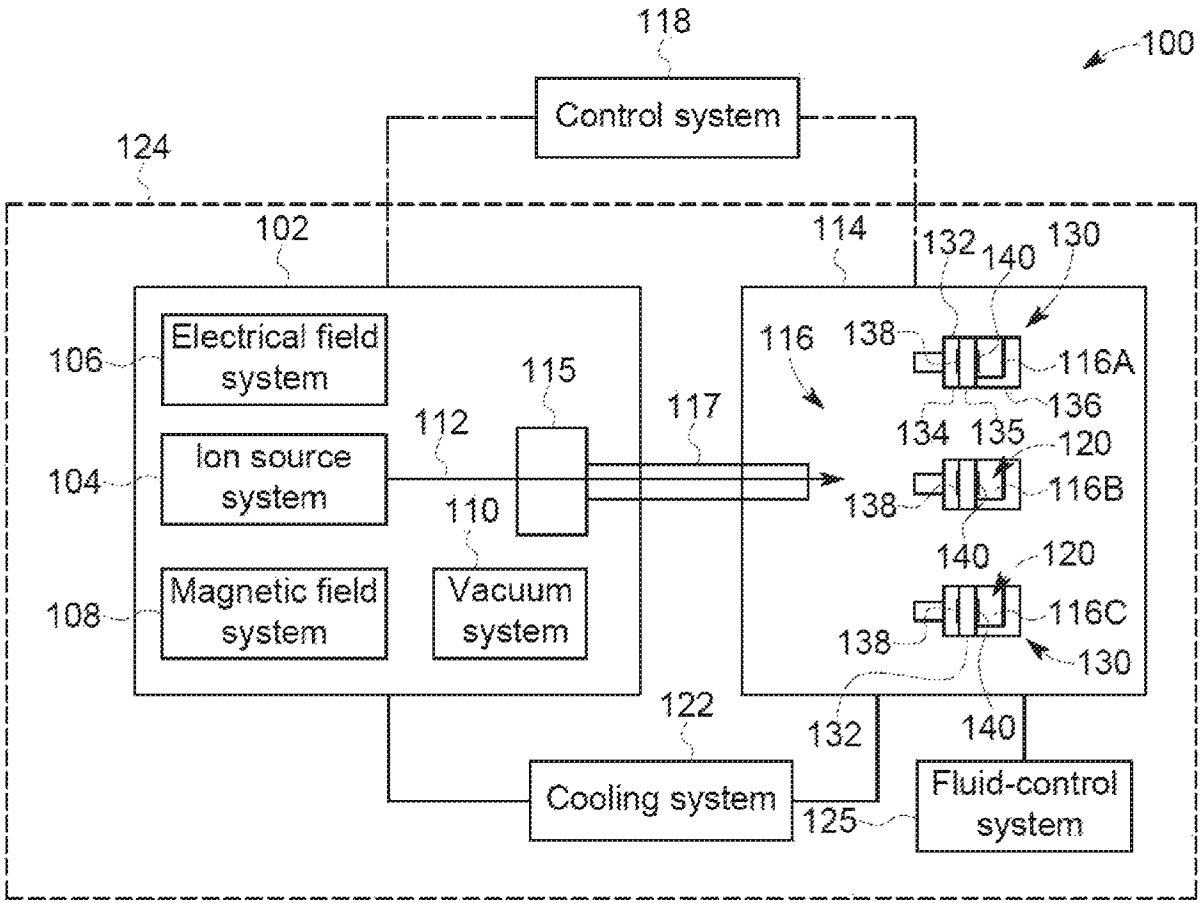
FIG. 1 is a block diagram of an isotope production system in accordance with an embodiment.

The foregoing summary, as well as the following detailed description of certain embodiments will be better understood when read in conjunction with the appended drawings. To the extent that the figures illustrate diagrams of the blocks of various embodiments, the blocks are not necessarily indicative of the division between hardware. Thus, for example, one or more of the blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Embodiments set forth herein may be or include a target foil that has a material layer comprising a nickel-based superalloy. As used herein, a "material layer" has an essentially uniform composition. The material layer may be the only layer in some embodiments. As such, the term "target foil" and "material layer" may be interchangeable for such embodiments. Optionally, the target foil may include multiple layers such that the material layer is only one layer of multiple layers (e.g., layers bonded together or discrete layers stacked side-by-side). Layers may be bonded together by, for example, coating or depositing one layer onto another layer.

As used herein, a "nickel-based superalloy" is an alloy in which the largest constituent of the alloy is nickel. The largest constituent is the element representing the largest percentage of weight (wt %) of the alloy. Superalloys are based on elements found in the long period of transition metals and include various combinations of Ni, Fe, Co and Cr, as well as lesser amounts of W, Mo, Ta, Nb, Ti, Al, Re, Ru, C, and B, among other elements. Superalloys can typically operate at temperatures in excess of 0.7 of the absolute melting temperature. Superalloys may have a face-centered cubic (FCC) crystal structure and be precipitation-hardened. A target foil of a nickel-based superalloy may be capable of operating at 400° C. or more throughout a session in which a particle beam is incident upon the liquid or gas target for producing desired radionuclides. Nickel-based superalloys may be cast or wrought.

The target foils are configured to operate within relatively harsh environments. For example, the production chamber may be pressurized up to 30 bar and the boiling temperature of the liquid (e.g., water) may be about 230° C. The temperature on the surface of the target foil that faces the acceleration chamber of the cyclotron may be higher than the temperature of the boiling liquid at certain locations on the target foil, such as the center or localized areas caused by insufficient cooling. For example, the temperature may be between 300° C. and 400° C. at the center and/or localized areas. In particular embodiments, the target foil may be configured to exceed 750 MPa at 500° C.

At least one technical effect in using target foils that include nickel-based superalloys is the ability to use higher beam currents (e.g., 100 ρA or more) than the beam currents presently used by some conventional systems. For example, a beam current that is greater than 100 μA at a beam energy of 16.5 MeV may be used. Production of radionuclides are a function of the beam current. As such, embodiments may enable generating greater amounts of radionuclides in shorter time periods compared to conventional systems. Another technical effect caused by the nickel-based superalloy is a different distribution of impurities generated during the session. For example, certain long-lived radioactive impurities (e.g. $^{56}$Co) may be reduced, thereby rendering operation and maintenance of the system safer for technicians.

FIG. 1 is a block diagram of an isotope production system 100 formed in accordance with an embodiment. The isotope production system 100 includes a particle accelerator 102 (e.g., cyclotron) having several sub-systems including an ion source system 104, an electrical field system 106, a magnetic field system 108, a vacuum system 110, a cooling system 122, and a fluid-control system 125. During use of the isotope production system 100, a target material 116 (e.g., target fluid, which may include a target liquid or a target gas) is provided to a designated production chamber 120 of the target system 114. The target material 116 may be provided to the production chamber 120 through the fluid-control system 125. The fluid-control system 125 may control flow of the target material 116 through one or more pumps and valves (not shown) to the production chamber 120. The fluid-control system 125 may also control a pressure that is experienced within the production chamber 120 by providing an inert gas into the production chamber 120.

During operation of the particle accelerator 102, charged particles are placed within or injected into the particle accelerator 102 through the ion source system 104. The magnetic field system 108 and electrical field system 106 generate respective fields that cooperate with one another in producing a particle beam 112 of the charged particles.

Also shown in FIG. 1, the isotope production system 100 has an extraction system 115. The target system 114 may be positioned adjacent to the particle accelerator 102. To generate isotopes, the particle beam 112 is directed by the particle accelerator 102 through the extraction system 115 along a beam path 117 and into the target system 114 so that the particle beam 112 is incident upon the target material 116 located at the designated production chamber 120. It should be noted that in some embodiments the particle accelerator 102 and the target system 114 are not separated by a space or gap (e.g., separated by a distance) and/or are not separate parts. Accordingly, in these embodiments, the particle accelerator 102 and target system 114 may form a single component or part such that the beam path 117 between components or parts is not provided.

The production system 100 is configured to produce radionuclides that may be used in medical imaging, research, and therapy, but also for other applications that are not medically related, such as scientific research or analysis. The isotope production system 100 may produce the isotopes in predetermined amounts or batches, such as individual doses for use in medical imaging or therapy. By way of example, the isotope production system 100 may generate $^{68}$Ga isotopes from a target liquid comprising $^{68}$Zn nitrate in dilute acid (e.g., nitric acid). The isotope production system 100 may also be configured to generate protons to make $[^{18}F]F^-$ in liquid form. The target material may be enriched $^{18}$O water for the production of $^{18}$F using the $^{18}O(p, n)^{18}F$ nuclear reaction. In some embodiments, the isotope production system 100 may also generate protons or deuterons in order to produce $^{15}$O labeled water. Isotopes having different levels of activity may be provided. $^{13}$N may be produced by proton bombardment of distilled water through the $^{16}O(p, a)^{13}N$ nuclear reaction. As yet another example, the target material may be a gas for the production of $^{11}$C via the $^{14}N(p,a)^{11}C$ reaction.

In some embodiments, the isotope production system 100 uses $^1H^-$ technology and brings the charged particles to a designated energy (e.g., 8-20 MeV) with a beam current of 100 μA or more. In such embodiments, the negative hydrogen ions are accelerated and guided through the particle accelerator 102 and into the extraction system 115. The negative hydrogen ions may then hit a stripper foil (not shown in FIG. 1) of the extraction system 115 thereby removing the pair of electrons and making the particle a positive ion, $^1H^+$. However, in alternative embodiments, the charged particles may be positive ions, such as $^1H^+$, $^2H^+$, and $^3He^+$. In such alternative embodiments, the extraction system 115 may include an electrostatic deflector that creates an electric field that guides the particle beam toward the target material 116. It should be noted that the various embodiments are not limited to use in lower energy systems, but may be used in higher energy systems, for example, up to 25 MeV.

The isotope production system 100 may include a cooling system 122 that transports a cooling fluid (e.g., water or gas, such as helium) to various components of the different systems in order to absorb heat generated by the respective components. For example, one or more cooling channels may extend proximate to the production chambers 120 and absorb thermal energy therefrom. The isotope production system 100 may also include a control system 118 that may be used to control the operation of the various systems and components. The control system 118 may include the necessary circuitry for automatically controlling the isotope production system 100 and/or allowing manual control of certain functions. For example, the control system 118 may include one or more processors or other logic-based circuitry. The control system 118 may include one or more user-interfaces that are located proximate to or remotely from the particle accelerator 102 and the target system 114. Although not shown in FIG. 1, the isotope production system 100 may also include one or more radiation and/or magnetic shields for the particle accelerator 102 and the target system 114.

The isotope production system 100 may be configured to accelerate the charged particles to a predetermined energy level. For example, some embodiments described herein accelerate the charged particles to an energy of at most 75 MeV, at most 50 MeV, or at most 25 MeV. In particular embodiments, the isotope production system 100 accelerates the charged particles to an energy of approximately at most 18 MeV or at most 16.5 MeV. In particular embodiments, the isotope production system 100 accelerates the charged particles to an energy of approximately at most 9.6 MeV. In more particular embodiments, the isotope production system 100 accelerates the charged particles to an energy of at most 7.8 MeV. However, embodiments describe herein may also have a higher beam energy. For example, embodiments may have a beam energy above 100 MeV, 500 MeV, or more.

One or more embodiments may permit using higher beam currents. For example, in some embodiments, the beam current may be at most 1500 μA or at most 1000 μA. In some embodiments, the beam current may be at most 500 μA or at most 250 μA. In some embodiments, the beam current may be at most 125 μA or at most 100 μA. In some embodiments, the beam current may be at most 75 μA or at most 50 μA. Embodiments may also use lower beam currents. By way of example, the beam current may be between about of approximately 10-30 μA.

In some embodiments, the beam current may be at least 100 μA at an energy of the particle beam that is 8-30 MeV. In certain embodiments, the beam current may be at least 125 μA at an energy of the particle beam that is 12-30 MeV. In certain embodiments, the beam current may be at least 150 μA at an energy of the particle beam that is 14-20 MeV.

The isotope production system 100 may have multiple production chambers 120 where separate target materials 116A-C are located. A shifting device or system (not shown) may be used to shift the production chambers 120 with respect to the particle beam 112 so that the particle beam 112 is incident upon a different target material 116. Alternatively, the particle accelerator 102 and the extraction system 115 may not direct the particle beam 112 along only one path, but may direct the particle beam 112 along a unique path for each different production chamber 120. Furthermore, the beam path 117 may be substantially linear from the particle accelerator 102 to the production chamber 120 or, alternatively, the beam path 117 may curve or turn at one or more points therealong. For example, magnets positioned alongside the beam path 117 may be configured to redirect the particle beam 112 along a different path.

The target system 114 includes a plurality of target assemblies 130, although the target system 114 may include only one target assembly 130 in other embodiments. The target assembly 130 includes a target body 132 having a plurality of body sections 134, 135, 136. The target assembly 130 is also configured to one or more foils through which the particle beam passes before colliding with the target material. For example, the target assembly 130 includes a front (or vacuum) foil 138 and a target foil 140. The front foil 138 and the target foil 140 may each engage a grid section (not shown in FIG. 1) of the target assembly 130.

Alternatively, the target assembly does not include a grid section. Such embodiments are described in U.S. Patent Application Publication No. 2011/0255646 and U.S. Patent Application Publication No. 2010/0283371.

Particular embodiments may be devoid of a direct cooling system for the front and target foils. Conventional target systems direct a cooling medium (e.g., helium) through a space that exists between the front and target foils. The cooling medium contacts the front and target foils and absorbs the thermal energy directly from the front and target and transfers the thermal energy away from the front and target foils. Embodiments set forth herein may be devoid of such a cooling system, and thus may, or may not, be devoid of a front foil that is upstream of the target foil. For example, a radial surface that surrounds this space may be devoid of ports that are fluidically coupled to channels. It should be understood, however, that the cooling system 122 may cool other objects of the target system 114. For instance, the cooling system 122 may direct cooling water through the body section 136 to absorb thermal energy from the production chamber 120. However, it should be understood that embodiments may include ports along the radial surface. Such ports may be used to provide a cooling medium for cooling the front and target foils 138, 140 or for evacuating the space between the front and target foils 138, 140.

Examples of isotope production systems and/or cyclotrons having one or more of the sub-systems described herein may be found in U.S. Patent Application Publication No. 2011/0255646, which is incorporated herein by reference in its entirety. Furthermore, isotope production systems and/or cyclotrons that may be used with embodiments described herein are also described in U.S. patent application Ser. Nos. 12/492,200; 12/435,903; 12/435,949; U.S. Patent Application Publication No. 2010/0283371 A1 and U.S. patent application Ser. No. 14/754,878, each of which is incorporated herein by reference in its entirety.

Figure 2:
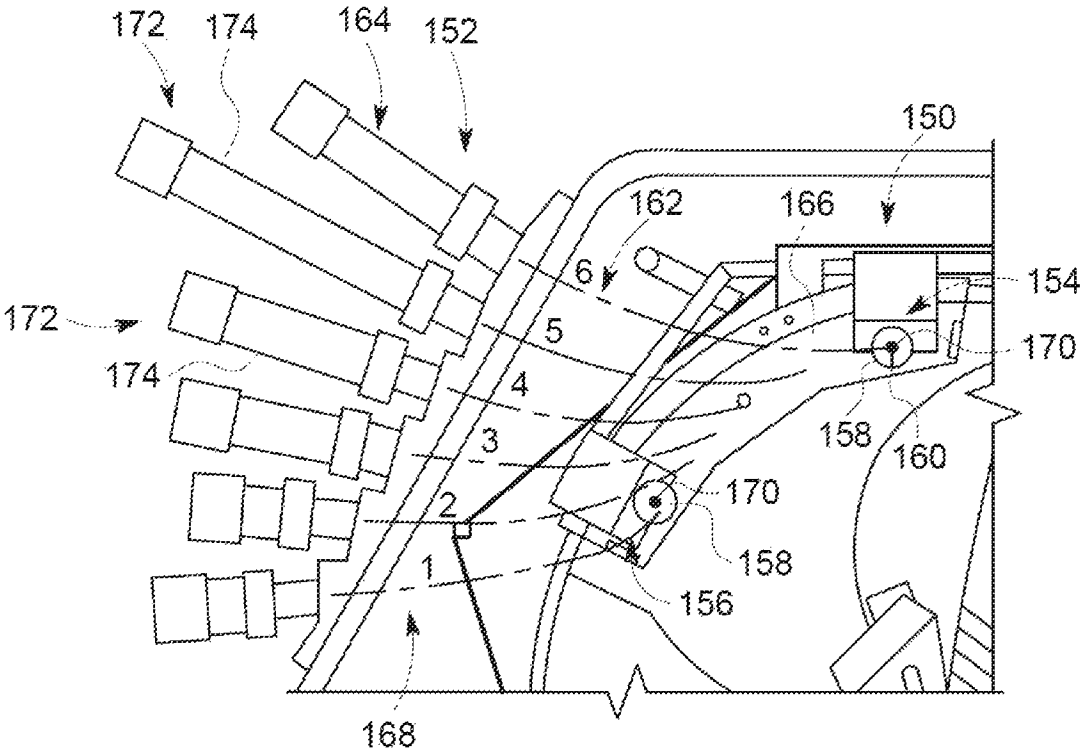
FIG. 2 is a side view of an extraction system and a target system in accordance with an embodiment.

FIG. 2 is a side view of the extraction system 150 and the target system 152. In the illustrated embodiment, the extraction system 150 includes first and second extraction units 156, 158 that each includes a foil holder 158 and one or more extraction foils 160 (also referred to as stripper foils). The extraction process may be based on a stripping-foil principle. More specifically, the electrons of the charged particles (e.g., the accelerated negative ions) are stripped as the charged particles pass through the extraction foil 160. The charge of the particles is changed from a negative charge to a positive charge thereby changing the trajectory of the particles in the magnet field. The extraction foils 160 may be positioned to control a trajectory of an external particle beam 162 that includes the positively-charged particles and may be used to steer the external particle beam 162 toward designated target locations 164.

In the illustrated embodiment, the foil holders 158 are rotatable carousels that are capable of holding one or more extraction foils 160. However, the foil holders 158 are not required to be rotatable. The foil holders 158 may be selectively positioned along a track or rail 166. The extraction system 150 may have one or more extraction modes. For example, the extraction system 150 may be configured for single-beam extraction in which only one external particle beam 162 is guided to an exit port 168. In FIG. 2, there are six exit ports 168, which are enumerated as 1-6.

The extraction system 150 may also be configured for dual-beam extraction in which two external beams 162 are guided simultaneously to two exit ports 168. In a dual-beam mode, the extraction system 150 may selectively position the extraction units 156, 158 such that each extraction unit intercepts a portion of the particle beam (e.g., top half and bottom half). The extraction units 156, 158 are configured to move along the track 166 between different positions. For example, a drive motor may be used to selectively position the extraction units 156, 158 along the track 166. Each extraction unit 156, 158 has an operating range that covers one or more of the exit ports 168. For example, the extraction unit 156 may be assigned to the exit ports 4, 5, and 6, and the extraction unit 158 may be assigned to the exit ports 1, 2, and 3. Each extraction unit may be used to direct the particle beam into the assigned exit ports.

The foil holders 158 may be insulated to allow for current measurement of the stripped-off electrons. The extraction foils 160 are located at a radius of the beam path where the beam has reached a final energy. In the illustrated embodiment, each of the foil holders 158 holds a plurality of extraction foils 160 (e.g., six foils) and is rotatable about an axis 170 to enable positioning different extraction foils 160 within the beam path.

The target system 152 includes a plurality of target assemblies 172. A total of six target assemblies 172 are shown and each corresponds to a respective exit port 168. When the particle beam 162 has passed the selected extraction foil 160, it will pass into the corresponding target assembly 172 through the respective exit port 168. The particle beam enters a target chamber (not shown) of a corresponding target body 174. The target chamber holds the target material (e.g., liquid, gas, or solid material) and the particle beam is incident upon the target material within the target chamber. The particle beam may first be incident upon one or more target foils within the target body 174, as described in greater detail below. The target assemblies 172 are electrically insulated to enable detecting a current of the particle beam when incident on the target material, the target body 174, and/or the target foils or other foils within the target body 174.

Examples of isotope production systems and/or cyclotrons having one or more of the sub-systems described herein may be found in U.S. Patent Application Publication No. 2011/0255646, which is incorporated herein by reference in its entirety. Furthermore, isotope production systems and/or cyclotrons that may be used with embodiments described herein are also described in U.S. patent application Ser. Nos. 12/492,200; 12/435,903; 12/435,949; 12/435,931 and U.S. patent application Ser. No. 14/754,878, each of which is incorporated herein by reference in its entirety.

Figure 3:
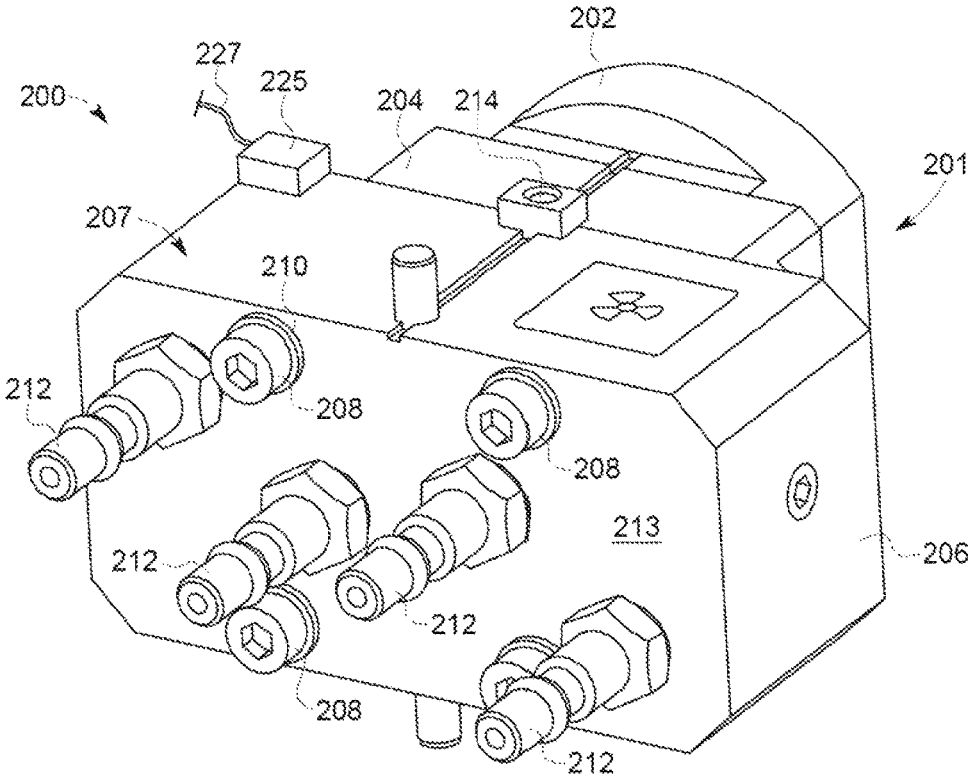
FIG. 3 is a rear perspective view of a target assembly in accordance with an embodiment.
Figure 4:
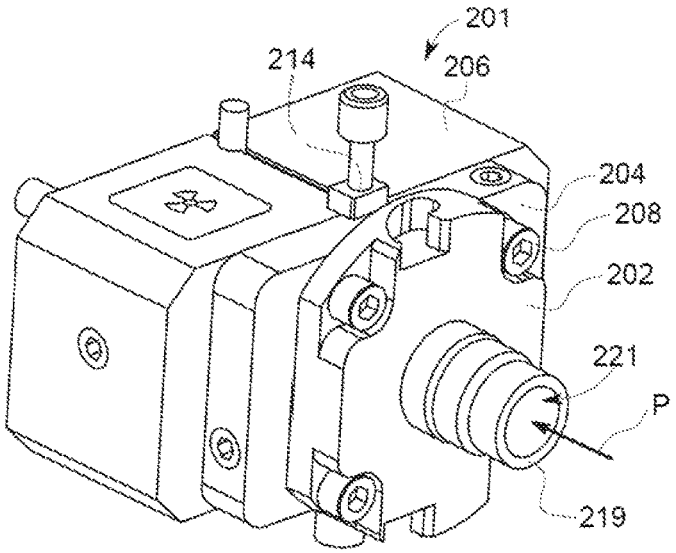
FIG. 4 is front perspective view of the target assembly of FIG. 3.

FIGS. 3 and 4 are rear and front perspective views, respectively, of a target assembly 200 formed in accordance with an embodiment. FIG. 4 is an exploded view of the target assembly 200. The target assembly 200 is configured for use in an isotope production system, such as the isotope production system 100 (FIG. 1). For example, the target assembly 200 may be similar or identical to the target assembly 130 (FIG. 1) of the isotope production system 100 or the target assembly 172 (FIG. 2). The target assembly 200 includes a target body 201, which is fully assembled in FIGS. 3 and 4.

Figure 5:
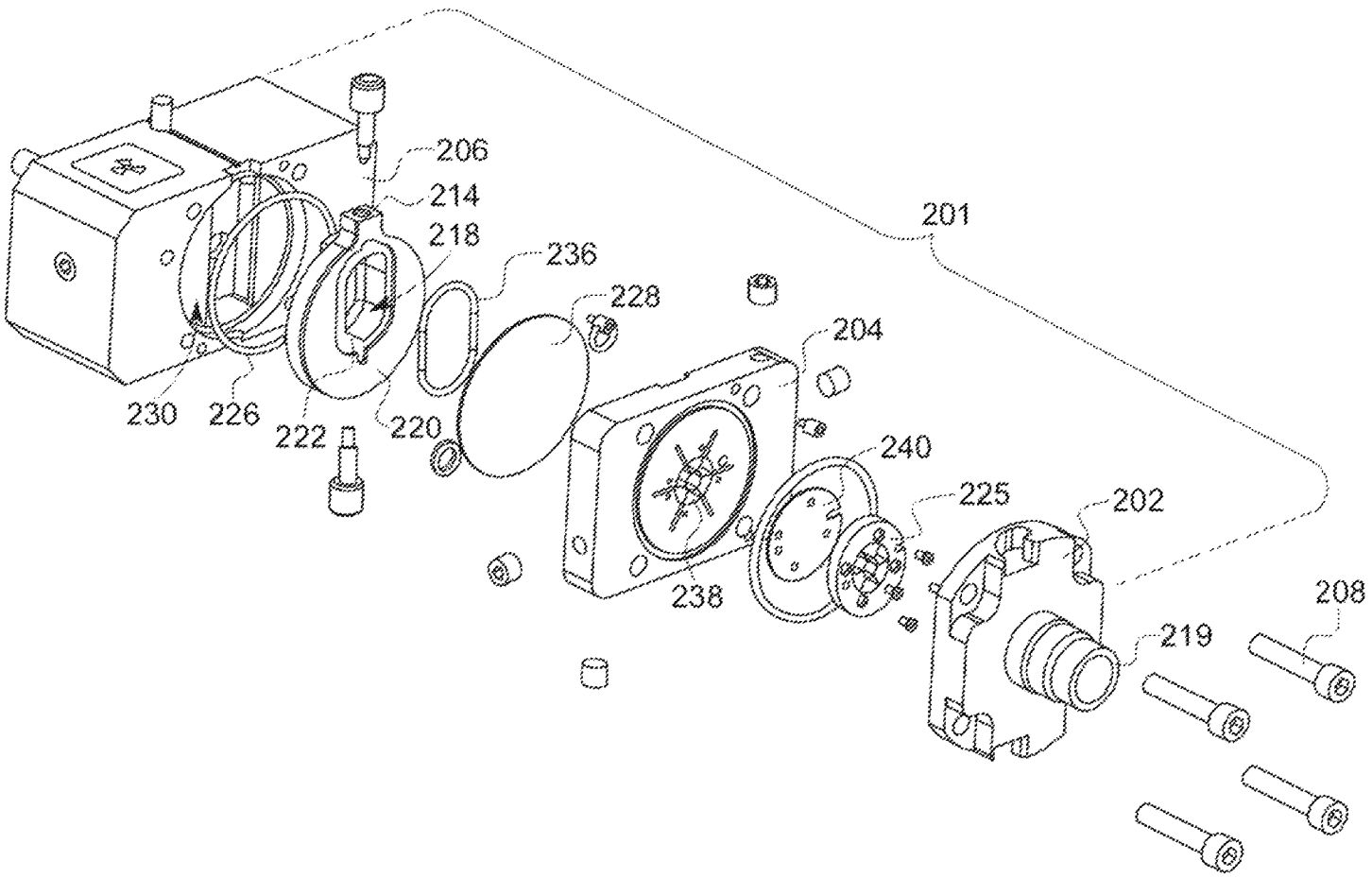
FIG. 5 is an exploded view of the target assembly of FIG. 3.

The target body 201 is formed from three body sections 202, 204, 206, a target insert 220 (FIG. 5), and a grid section 225 (FIG. 5). The body sections 202, 204, 206 define an outer structure or exterior of the target body 201. In particular, the outer structure of the target body 201 is formed from the body section 202 (which may be referred to as a front body section or flange), the body section 204 (which may be referred to as an intermediate body section) and the body section 206 (which may be referred to as a rear body section). The body sections 202, 204 and 206 include blocks of rigid material having channels and recesses to form various features. The channels and recesses may hold one or more components of the target assembly 200.

The target insert 220 and the grid section 225 (FIG. 5) also include blocks of rigid material having channels and recesses to form various features. The body sections 202, 204, 206, the target insert 220, and the grid section 225 may be secured to one another by suitable fasteners, illustrated as a plurality of bolts 208 (FIGS. 4 and 5) each having a corresponding washer (not shown). When secured to one another, the body sections 202, 204, 206, the target insert 220, and the grid section 225 form a sealed target body 201. The sealed target body 201 is sufficiently constructed to prevent or severely limit leakage of fluids or gas form the target body 201.

As shown in FIG. 3, the target assembly 200 includes a plurality of fittings 212 that are positioned along a rear surface 213. The fittings 212 may operate as ports that provide fluidic access into the target body 201. The fittings 212 are configured to be operatively coupled to a fluid-control system, such as the fluid-control system 125 (FIG. 1). The fittings 212 may provide fluidic access for helium and/or cooling water. In addition to the ports formed by the fittings 212, the target assembly 200 may include a first material port 214 and a second material port 215 (shown in FIG. 7). The first and second material ports 214, 215 are in flow communication with a production chamber 218 (FIG. 5) of the target assembly 200. The first and second material ports 214, 215 are operatively coupled to the fluid-control system. In an exemplary embodiment, the second material port 215 may provide a target material to the production chamber 218, and the first material port 214 may provide a working gas (e.g., inert gas) for controlling the pressure experienced by the target fluid within the production chamber 218. In other embodiments, however, the first material port 214 may provide the target material and the second material port 215 may provide the working gas.

The target body 201 forms a beam passage 221 that permits a particle beam (e.g., proton beam) to be incident on the target material within the production chamber 218. The particle beam (indicated by arrow P in FIG. 4) may enter the target body 201 through a passage opening 219 (FIGS. 4 and 5). The particle beam travels through the target assembly 200 from the passage opening 219 to the production chamber 218 (FIG. 5). During operation, the production chamber 218 is filled with a target liquid or a target gas. For example, the target liquid may be about 2.5 milliliters (ml) of water comprising designated isotopes (e.g., $H_2{}^{18}O$). The production chamber 218 is defined within the target insert 220 that may comprise, for example, a niobium material having a cavity 222 (FIG. 5) that opens on one side of the target insert 220. The target insert 220 includes the first and second material ports 214, 215. The first and second material ports 214, 215 are configured to receive, for example, fittings or nozzles.

With respect to FIG. 5, the target insert 220 is aligned between the body section 206 and the body section 204. The target assembly 200 may include a sealing ring 226 that is positioned between the body section 206 and the target insert 220. The target assembly 200 also includes a target foil 228 and a sealing border 236 (e.g., a Helicoflex® border). The target foil 228 is positioned between the body section 204 and the target insert 220 and covers the cavity 222 thereby enclosing the production chamber 218. The body section 206 also includes a cavity 230 (FIG. 5) that is sized and shaped to receive therein the sealing ring 226 and a portion of the target insert 220.

A front foil 240 of the target assembly 200 may be positioned between the body section 204 and the body section 202. The front foil 240 may be an alloy disc similar to the target foil 228. The front foil 240 aligns with a grid section 238 of the body section 204. The front foil 240 and the target foil 228 may have different functions in the target assembly 228. In some embodiments, the front foil 240 may be referred to as a degrader foil that reduces the energy of the particle beam P. For example, the front foil 240 may reduce the energy of the particle beam by at least 10%. The energy of the particle beam that is incident upon the target material may be between 7 MeV and 24 MeV. In more particular embodiments, the energy of the particle beam that is incident upon the target material may be between 13 MeV and 15 MeV.

The target foil 228 comprises a single material layer or multiple material layers. In some embodiments, the target foil 228 consists of or consists essentially of only a single material layer. As used herein, a "material layer" has an essentially uniform composition throughout. For example, the target foil 228 may have a nickel-based superalloy layer in which the layer has a composition that is similar or identical to the compositions shown in FIG. 6.

The material layer may be designed or selected to have predetermined qualities. Parameters that may be used to select the target foil include thermal conductivity, tensile strength, yield strength at designated high temperatures, chemical reactivity (inertness), energy degradation properties, radioactive activation, and melting point. By way of example, a density of the target foil may be between 7.0-10.0 g/cm$^3$, a melting point may be 1200° C. or more, a thermal conductivity may be at least 10.0 W/m*K, and a tensile strength of at least 250000 psi or 1725 MPa. For embodiments in which the target material is a gas for the production of $^{11}$C via the $^{14}$N(p,a)$^{11}$C reaction, the tensile strength during operation is at least 800 MPa. For such embodiments, the target foil may have between a low carbon content and a carbon content that is essentially zero.

In particular embodiments, a thickness of the target foil 228 may be at least 10 micrometers or at least 20 micrometers. In more particular embodiments, the thickness of the target foil 228 may be at least 25 micrometers or at least 30 micrometers or at least 40 micrometers. In more particular embodiments, the thickness of the target foil 228 may be at least 50 micrometers or at least 60 micrometers. In particular embodiments, a thickness of the target foil 228 may be at most 100 micrometers or at most 75 micrometers or at most 50 micrometers. One or more embodiments may have a thickness of the target foil that is between 10 micrometers and 50 micrometers. It should be understood, however, that other dimensions (e.g., thicknesses) may be used by various embodiments. For example, greater thicknesses or smaller thicknesses other than those described herein may be used.

Figure 8:
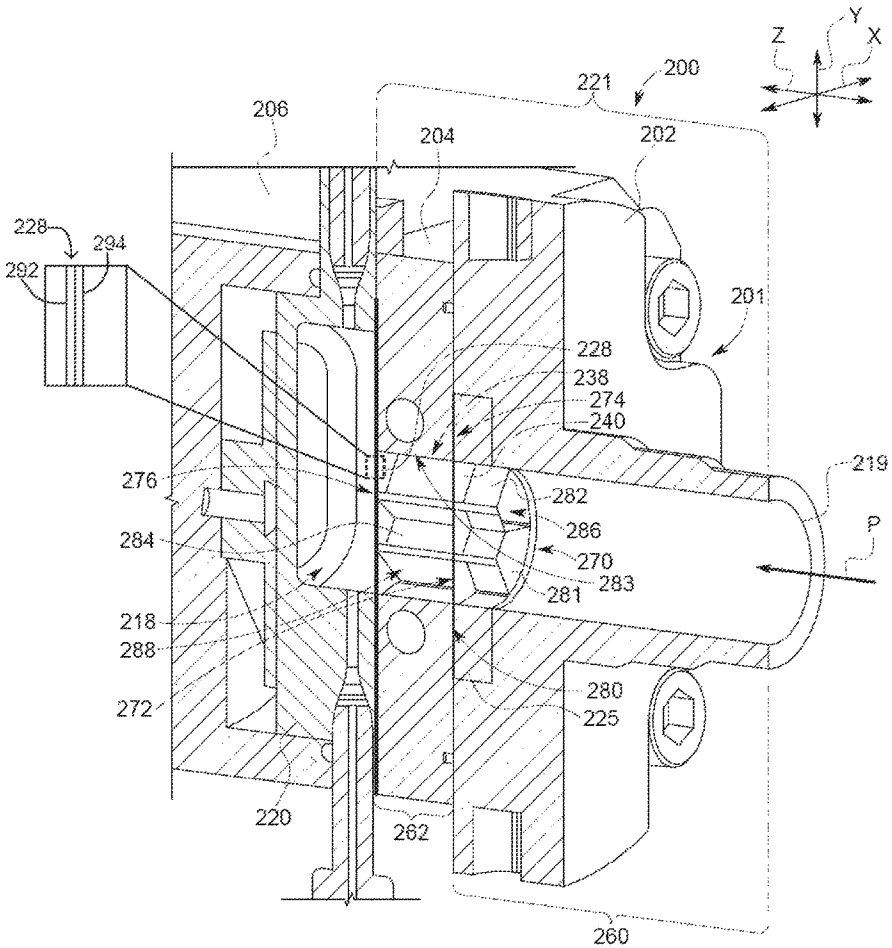
FIG. 8 is a sectional view of the target assembly of FIG. 3 taken transverse to an X axis.

The target foil 228 has a side 293 that is exposed to the production chamber 218 such that the target foil 228 is in contact with the target material during isotope production. Optionally, the target foil 228 may include a layer that is not a nickel-based alloy layer (e.g. a secondary foil, or, coating). For example, an inner layer may be stacked or coated with respect to the nickel-based alloy layer. FIG. 8 illustrates one such target foil configuration 228. As shown, the target foil 228 includes a secondary material layer 292 and a primary material layer (or nickel-based alloy layer) 294 stacked with respect to each other. The secondary material layer 292 includes the side 293 of the target foil 228 that is in contact with the target material. As used herein, the secondary material layer (or secondary layer) and the nickel-based alloy layer are "stacked with respect to each other" if respective sides of the secondary layer and the nickel-based alloy layer face each other and the sides (a) are essentially secured to each other in which, for example, the surfaces are bonded to each other or one layer is deposited (e.g., sputtered, plated, or coated) to the other layer; (b) are discrete but directly engage each other (e.g., are pressed together); or (c) have one or more other layers positioned therebetween and are essentially secured to the one or more other layers or directly engage the one or more other layers. For example, each of the sides may directly engage or be bonded to opposite sides of a common layer. If multiple layers exists, the multiple layers may be sandwiched together. The nickel-based alloy layer and the secondary layer engage or are bonded to opposite sides of the sandwich structure. In some embodiments, the nickel-based alloy layer may engage other layers on either side of the nickel-based alloy layer.

In particular embodiments, the secondary layer is configured to be exposed to the target material within the production chamber. The secondary layer may be configured to reduce generation of long-lived isotopes when activated by the particle beam and exposed to the target material. The secondary layer may be configured to reduce chemical contaminants and long-lived radionuclides contaminants. The secondary layer may also be an inert metal material. For instance, the secondary layer may comprise refractory or platinum-group metals or alloys. The secondary layer may comprise, for example, gold, niobium, tantalum, titanium, or an alloy including one or more of the above. In particular embodiments, the secondary layer may consist essentially of gold, niobium, tantalum, or titanium.

It should be noted that the target and front foils 228, 240 are not limited to a disc or circular shape and may be provided in different shapes, configurations and arrangements. For example, one or both of the target and front foils 228, 240, or additional foils, may be square shaped, rectangular shaped, or oval shaped, among others. Also, it should be noted that the target foils 228, are not limited to being formed from nickel-based superalloys. In some embodiments, the target and front foils 228, 240 may include one or more metallic layers. The layers may include, for example, Havar. Havar has a nominal composition of cobalt (42.0 wt %), chromium (19.5 wt %), nickel (12.7 wt %), tungsten (2.7 wt %), molybdenum (2.2 wt %), manganese (1.6 wt %), carbon (0.2 wt %), and iron (balance).

During operation, as the particle beam passes through the target assembly 200 from the body section 202 into the production chamber 218, the target and front foils 228, 240 may be heavily activated (e.g., radioactivity induced therein). The target and front foils 228, 240 isolate a vacuum inside the accelerator chamber from the target material in the cavity 222. The grid section 238 may be disposed between and engage each of the target and front foils 228, 240. Optionally, the target assembly 200 is not configured to permit a cooling medium to pass between the target and front foils 228, 240. It should be noted that the target and front foils 228, 240 are configured to have a thickness that allows a particle beam to pass therethrough. Consequently, the target and front foils 228, 240 may become highly radiated and activated.

Some embodiments provide self-shielding of the target assembly 200 that actively shields the target assembly 200 to shield and/or prevent radiation from the activated target and front foils 228, 240 from leaving the target assembly 200. Thus, the target and front foils 228, 240 are encapsulated by an active radiation shield. Specifically, at least one of, and in some embodiments, all of the body sections 202, 204 and 206 are formed from a material that attenuates the radiation within the target assembly 200, and in particular, from the target and front foils 228, 240. It should be noted that the body sections 202, 204 and 206 may be formed from the same materials, different materials or different quantities or combinations of the same or different materials. For example, body sections 202 and 204 may be formed from the same material, such as aluminum, and the body section 206 may be formed from a combination or aluminum and tungsten.

The body section 202, body section 204 and/or body section 206 are formed such that a thickness of each, particularly between the target and front foils 228, 240 and the outside of the target assembly 200 provides shielding to reduce radiation emitted therefrom. It should be noted that the body section 202, body section 204 and/or body section 206 may be formed from any material having a density value greater than that of aluminum. Also, each of the body section 202, body section 204 and/or body section 206 may be formed from different materials or combinations or materials as described in more detail herein.

FIG. 6 includes a table that lists examples of nickel-based alloys that may be used in one or more embodiments to form a material layer of a target foil. Percent weights of elements in the alloy of the material layer are shown. As shown, the values listed for a composition may not sum to 100%. It should be understood that the values are approximate and can be adjusted to achieve a suitable alloy. It should also be understood that other alloys not listed in FIG. 6 can be used for some embodiments. For example, the alloys in FIG. 6 illustrate a range of possible values that the different metals and other alloy agents may have in some embodiments.

In particular embodiments, the composition of the material layer is the composition for Alloy 1, Alloy 3, or Alloy 4 in FIG. 6. The largest constituent of the nickel-based alloy is nickel. For example, the nickel may be at least 40 wt % (percent weight) of the material layer. In some embodiments, the nickel is at least 45 wt % or at least 50 wt % of the material layer. In some embodiments, the nickel is at least 55 wt % or at least 60 wt % of the material layer. In some embodiments, the nickel is at least 65 wt % or at least 70 wt % of the material layer. In some embodiments, the nickel is at least 75 wt % of the material layer. In some embodiments, the nickel is at most 75 wt % of the material layer.

In some embodiments, the nickel may be between 45 wt % and 75 wt % of the material layer. In particular embodiments, the nickel may be between 50 wt % and 75 wt % of the material layer. In more particular embodiments, the nickel may be between 55 wt % and 75 wt % of the material layer.

Other large constituents of the target foil may include cobalt, iron, chromium, or molybdenum. For example, the percent weight for cobalt may be between 0 wt % and 20 wt % or, more particularly, between 10 wt % and 20 wt %. The percent weight for iron may be between 0 wt % and 30 wt % or, more particularly, between 0 wt % and 10 wt % or more particularly, between 0 wt % and 5 wt %. A target foil with a relatively low iron content (e.g., less than 10% or less than 5%) may reduce the radiation burden of the target foil. The target foils may expose a technician to less radiation and/or require replacement of the target foil less frequently. The percent weight for chromium may be between 8 wt % and 20 wt % or, more particularly, between 15 wt % and 20 wt %. The percent weight for molybdenum may be between 0 wt % and 25 wt % or, more particularly, between 0 wt % and 10 wt % or more particularly, between 0 wt % and 3 wt %.

In some embodiments, the sum of the percent weights for aluminum and titanium are less than 10 wt %. For example, Alloy 1 has aluminum (4.5 wt %) and titanium (0.5 wt %), the sum of which equals 5.0 wt %. Alloy 4 has aluminum (1.5 wt %) and titanium (3 wt %), the sum of which equals 4.5 wt %. In particular embodiments, the sum of the percent weights for aluminum and titanium are between 1.5 wt % and 8 wt %. In particular embodiments, the sum of the percent weights for aluminum and titanium are between 2.5 wt % and 6 wt %.

In some embodiments, the material layer comprises nickel (75 wt %), cobalt (2 wt %), iron (3 wt %), chromium (16 wt %), molybdenum (0.5 wt %), tungsten (0.5 wt %), manganese (0.5 wt %), silicon (0.2 wt %), niobium (0.15 wt %), aluminum (4.5 wt %), titanium (0.5 wt %), carbon (0.04 wt %), boron (0.01 wt %), and zirconium (0.1 wt %).

In some embodiments, the material layer comprises nickel (65 wt %), cobalt (1 wt %), iron (2 wt %), chromium (8 wt %), molybdenum (25 wt %), manganese (0.8 wt %), silicon (0.8 wt %), aluminum (0.5 wt %), carbon (0.03 wt %), boron (0.006 wt %), and copper (0.5 wt %).

In some embodiments, the material layer comprises nickel (58 wt %), cobalt (13.5 wt %), iron (2 wt %), chromium (19 wt %), molybdenum (4.3 wt %), manganese (0.1 wt %), silicon (0.15 wt %), aluminum (1.5 wt %), titanium (3.0 wt %), carbon (0.08 wt %), boron (0.006 wt %), zirconium (0.05 wt %), and copper (0.1 wt %).

Figure 7:
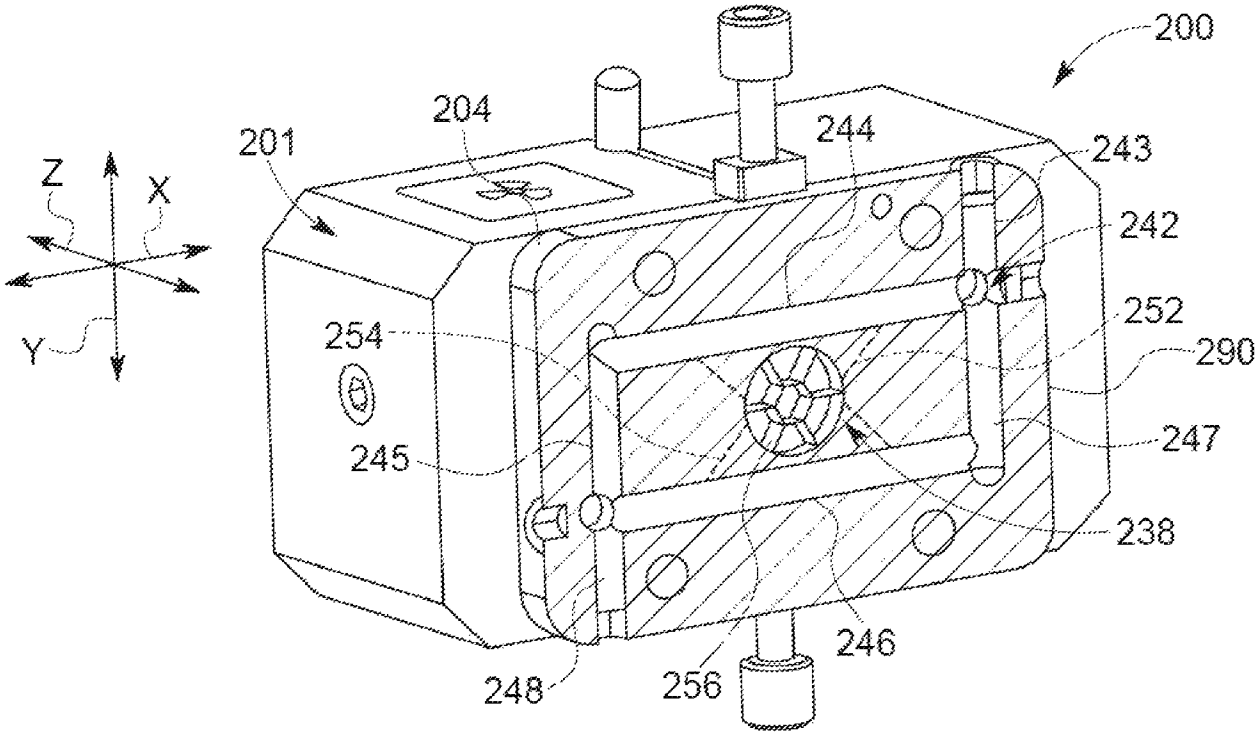
FIG. 7 is a sectional view of the target assembly taken transverse to a Z axis illustrating a cooling channel that absorbs thermal energy of the target assembly.

FIG. 7 is a sectional view of the target assembly 200. For reference, the target assembly 200 is oriented with respect to mutually perpendicular X, Y, and Z axes. The sectional view is made by a plane 290 that is oriented transverse to the Z axis and through the body section 204. In the illustrated embodiment, the body section 204 is an essentially uniform block of material that is shaped to include the grid section 238 and a cooling network 242. For example, the body section 204 may be molded or die-cast to include the physical features described herein. In other embodiments, the body section 204 may comprise two or more elements that are secured to each other. For example, the grid section 238 may be similarly shaped as the grid section 225 (FIG. 5) and be separate and discrete with respect to a remaining portion of the body section 204. In this alternative embodiment, the grid section 238 may be positioned within a void or cavity of the remaining portion.

As shown, the plane 290 through the body section 204 intersects the grid section 238 and the cooling network 242. The cooling network 242 includes cooling channels 243-248 that interconnect with one another to form the cooling network 242. The cooling network 242 also includes ports 249, 250 that are in flow communication with other channels (not shown) of the target body 201. The cooling network 242 is configured to receive a cooling medium (e.g., cooling water) that absorbs thermal energy from the target body 201 and transfers the thermal energy away from the target body 201. For example, the cooling network 242 may be configured to absorb thermal energy from at least one of the grid section 238 or the target chamber 218 (FIG. 5). As shown, the cooling channels 244, 246 extend proximate to the grid section 238 such that respective thermal paths 252, 254 (generally indicated by dashed lines) are formed between the grid section 238 and the cooling channels 244, 246. For example, gaps between the grid section 238 and the cooling channels 244, 246 may be less than 10 mm, less than 8 mm, less than 6 mm, or, in certain embodiments, less than 4 mm. Thermal paths may be identified using, for example, modeling software or thermal imaging during experimental setups.

The grid section 238 includes an arrangement of interior walls 256 that coupled to one another to form a grid or frame structure. The interior walls 256 may be configured to (a) provide sufficient support for the target and front foils 228, 240 (FIG. 5) and (b) intimately engage the target and front foils 228, 240 so that thermal energy may be transferred from the target and front foils 228, 240 to the interior walls 256 and a peripheral region of the grid section 238 or the body section 204.

Figure 9:
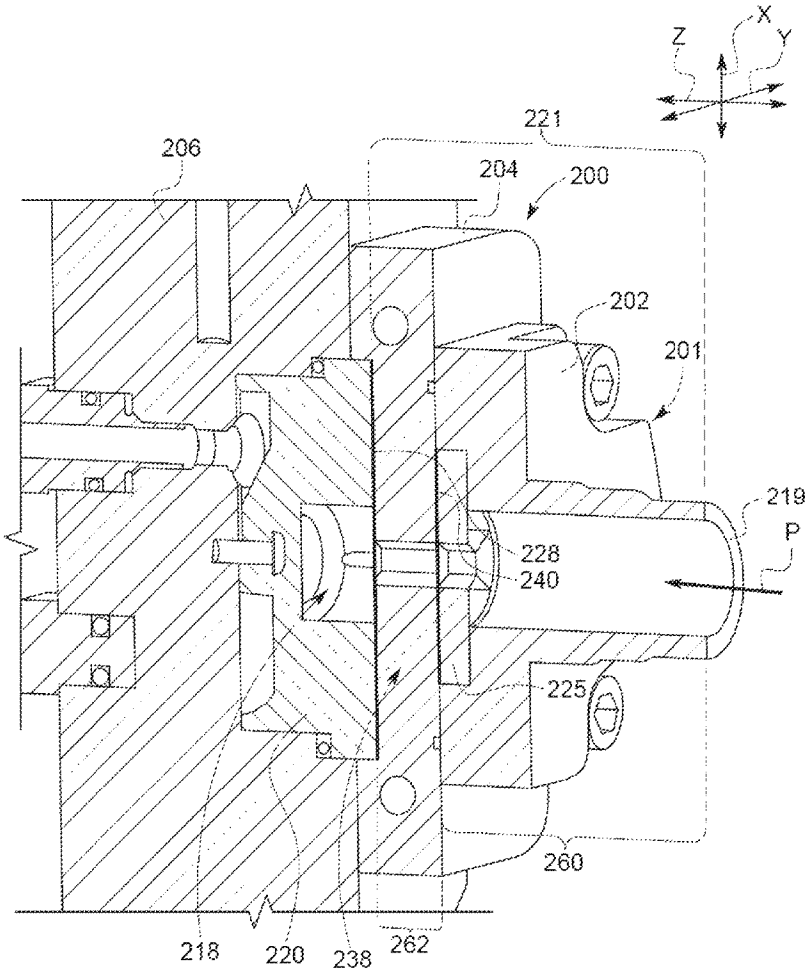
FIG. 9 is a sectional view of the target assembly of FIG. 3 taken transverse to a Y axis.

FIGS. 8 and 9 are sectional views of the target assembly 200 taken transverse to the X and Y axes, respectively. As shown the target assembly 200 is in an operable state in which the body sections 202, 204, 206, the target insert 220, and the grid section 225 are stacked with respect to one another along the Z axis and secured to one another. It should be understood that the target body 201 shown in the figures is one particular example of how a target body may be configured and assembled. Other target body designs that include the operable features (e.g., grid section(s)) are contemplated.

The target body 201 includes a series of cavities or voids through which the particle beam P extends through. For example, the target body 201 includes the production chamber 218 and the beam passage 221. The production chamber 218 is configured to hold a target material (not shown) during operation. The target material may flow into and out of the production chamber 218 through, for example, the first material port 214. The production chamber 218 is positioned to receive the particle beam P that is directed through the beam passage 221. The particle beam P is received from a particle accelerator (not shown), such as the particle accelerator 102 (FIG. 1), which is a cyclotron in the exemplary embodiment.

The beam passage 221 includes a first passage segment (or front passage segment) 260 that extends from the passage opening 219 to the front foil 240. The beam passage 221 also includes a second passage segment (or rear passage segment) 262 that extends between the front foil 240 and the target foil 228. For illustrative purposes, the front foil 240 and the target foil 228 have been thickened for easier identification. The grid section 225 is positioned at an end of the first passage segment 260. The grid section 238 defines an entirety of the second passage segment 262. In the illustrated embodiment, the grid section 238 is an integral part of the body section 204 and the grid section 225 is a separate and discrete element that is sandwiched between the body section 202 and the body section 204.

Accordingly, the grid sections 225, 238 of the target body 201 are disposed in the beam passage 221. As shown in FIG. 8, the grid section 225 has a front side 270 and a back side 272. The grid section 238 also has a front side 274 and a back side 276. The back side 272 of the grid section 225 and the front side 274 of the grid section 238 abut each other with an interface 280 therebetween. The back side 276 of the grid section 238 faces the production chamber 218. In the illustrated embodiment, the back side 276 of the grid section 238 engages the target foil 228. The front foil 240 is positioned between the grid sections 225, 238 at the interface 280.

Also shown in FIG. 8, the grid section 225 has a radial surface 281 that surrounds the beam passage 221 and defines a profile of a portion of the beam passage 221. The profile extends parallel to a plane defined by the X and Y axes. The grid section 238 has a radial surface 283 that surrounds the beam passage 221 and defines a profile of a portion of the beam passage 221. The profile extends parallel to a plane defined by the X and Y axes. In the illustrated embodiment, the radial surface 283 is devoid of ports that are fluidically coupled to channels of the target body. More specifically, the second passage segment 262 may not have forced fluid pumped therethrough for cooling the target and front foils 228, 240 in some embodiments. In alternative embodiments, however, a cooling medium may be pumped therethrough. Yet in other embodiments, ports may be used to evacuate the second passage segment 262.

The grid sections 225, 238 have respective interior walls 282, 284 that define grid channels 286, 288 therethrough. The interior walls 282, 284 of the grid sections 225, 238, respectively, engage opposite sides of the front foil 240. The interior walls 284 of the grid section 238 engage the target foil 228 and the front foil 240. The interior walls 282 of the grid section 225 only engage the front foil 240. The front and target foils 240, 228 are oriented transverse to a beam path of the particle beam P. The particle beam P is configured to pass through the grid channels 286, 288 toward the production chamber 218.

In some embodiments, the grid structure formed by the interior walls 282 and the grid structure formed by the interior walls 284 are identical such that the grid channels 286, 288 align with one another. However, embodiments are not required to have identical grid structures. For example, the grid section 225 may not include one or more of the interior walls 282 and/or one or more of the interior walls 282 may not be aligned with corresponding interior walls 284 or vice versa. Moreover, it is contemplated that the interior walls 282 and the interior walls 284 may have different dimensions in other embodiments.

Optionally, the front foil 240 is configured to substantially reduce the energy level of the particle beam P when the particle beam P is incident on the front foil 240. More specifically, the particle beam P may have a first energy level in the first passage segment 260 and a second energy level in the second passage segment 262 in which the second energy level is substantially less than the first energy level. For example, the second energy level may be more than 5 wt % less than the first energy level (or 95 wt % or less of the first energy level). In certain embodiments, the second energy level may be more than 10 wt % less than the first energy level (or 90 wt % or less of the first energy level). Yet in more particular embodiments, the second energy level may be more than 15 wt % less than the first energy level (or 85 wt % or less of the first energy level). Yet in more particular embodiments, the second energy level may be more than 20 wt % less than the first energy level (or 80 wt % or less of the first energy level). By way of example, the first energy level may be about 18 MeV, and the second energy level may be about 14 MeV. It should be understood, however, that the first energy level may have different values in other embodiments and the second energy level may have different values in other embodiments.

In such embodiments in which the front foil 240 substantially reduces the energy level of the particle beam P, the front foil 240 may be characterized as a degrader foil. The degrader foil 240 may have a thickness and/or composition that creates substantial losses as the particle beam P passes through the front foil 240. For example, the front foil 240 and the target foil 228 may have different compositions and/or thicknesses. The front foil 240 may comprise aluminum, and the target foil 228 may comprise a nickel-based superalloy as described herein. Alternatively, the front foil 240 may also comprise nickel-based superalloy.

In particular embodiments, the front foil 240 and the target foil 228 have different thicknesses. For example, a thickness of the front foil 240 may be at least 0.10 millimeters (mm) (or 100 micrometers). In particular embodiments, the front foil 240 has a thickness that is between 0.15 mm and 0.50 mm.

In some embodiments, the target foil 228 is at least five times (5×) thicker than the stripper foil 160 or is at least eight times (8×) thicker than the stripper foil 160. In particular embodiments, the target foil 228 is at least ten times (10×) thicker than the stripper foil 160, at least fifteen times (15×) thicker than the stripper foil 160, or at least twenty times (20×) thicker than the stripper foil 160.

Although the front foil 240 may be characterized as a degrader foil in some embodiments, the front foil 240 may not be a degrader foil in other embodiments. For instance, the front foil 240 may not substantially reduce or only nominally reduce the energy level of the particle beam P. In such instances, the front foil 240 may have characteristics (e.g., thickness and/or composition) that are similar to characteristics of the target foil 228.

The losses in the front foil 240 correspond to thermal energy that is generated within the front foil 240. The thermal energy generated within the front foil 240 may be absorbed by the body section 204, including the grid section 238, and conveyed to the cooling network 242 where the thermal energy is transferred from the target body 201.

The production chamber 218 is defined by an interior surface 266 of the target insert 220 and the target foil 228. As the particle beam P collides with the target material, thermal energy is generated. This thermal energy may be absorbed by the cooling medium flowing through the cooling network 242.

During operation of the target assembly 200, the different cavities may experience different pressures. For example, as the particle beam P is incident upon the target material, the first passage segment 260 may have a first operating pressure, the second passage segment may 262 may have a second operating pressure, and the production chamber 218 may have a third operating pressure. The first passage segment 262 is in flow communication with the particle accelerator, which may be evacuated. Due to the thermal energy and bubbles generated within the production chamber 218, the third operating pressure may be significantly large. For example, the pressure may be between 0.50 and 15.00 megapascals (MPa) or, more specifically, between 0.50 and 11.00 MPa. Moreover, the pressure may rise and fall rapidly such that the target foil 228 experiences bursts of high pressure depending upon the target material.

In the illustrated embodiment, the second operating pressure may be a function of the operating temperature of the grid section 238. Thus, the first operating pressure may be less than the second operating pressure and the second operating pressure may be less than the third operating pressure.

The grid sections 225, 238 are configured to intimately engage opposite sides of the front foil 240. In addition, the interior walls 282 may prevent the pressure differential between the second passage segment 262 and the first passage segment 260 from moving the front foil 240 away from the interior walls 284. The interior walls 284 may prevent the pressure differential between the production chamber 218 and the second passage segment 262 from moving the target foil 228 into the second passage segment 262. The larger pressure in the production chamber 218 forces the target foil 228 against the interior walls 284. Accordingly, the interior walls 284 may intimately engage the front foil 240 and the target foil 228 and absorb thermal energy therefrom. Also show in FIGS. 8 and 9, the surrounding body section 204 may also intimately engage the front foil 240 and the target foil 228 and absorb thermal energy therefrom.

In particular embodiments, the target assembly 200 is configured to generate isotopes that are disposed within a target fluid (e.g., gas or liquid) that may be harmful to the particle accelerator. For example, the starting target material may include an acidic solution. To impede the flow of this solution, the front foil 240 may entirely cover the beam passage 221 such that the first passage segment 260 and the second passage segment 262 are not in flow communication. In this manner, unwanted acidic material may not inadvertently flow from the production chamber 218, through the second and first passage segments 262, 260, and into the particle accelerator. To decrease this likelihood, the front foil 240 may be more resistant to rupture. For instance, the front foil 240 may comprise a material having a greater structural integrity (e.g., aluminum) and a thickness that reduces the likelihood of rupture.

In other embodiments, the target assembly 200 is devoid of the target foil 228, but includes the front foil 240. In such embodiments, the grid section 238 may form a part of the production chamber. For example, the target material may be a gas and be located within a production chamber that is defined between the front foil 240 and cavity 222. The grid section 238 may be disposed in the production chamber. In such embodiments, only a single foil (e.g., the front foil 240) is used during production and the single foil may be held between the two grid sections 225, 238.

Figure 10:
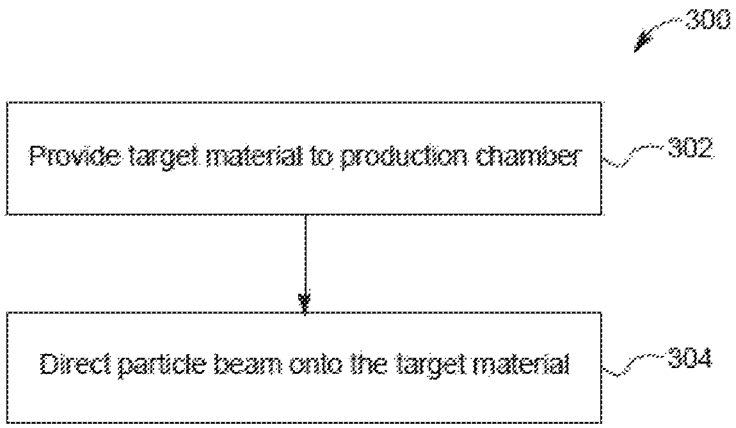
FIG. 10 is a flowchart illustrating a method in accordance with an embodiment.

FIG. 10 illustrates a method 300 of generating radionuclides. The method 300, for example, may employ structures or aspects of various embodiments (e.g., isotope production systems, target systems, and/or methods) described herein. The method includes providing, at 302, a target material into a production chamber of a target body or target assembly, such as the target body 201 or the target assembly 200. In some embodiments, the target material is an acidic solution. In particular embodiments, the method 300 is configured to generate $^{18}F$ using the $^{18}O(p, n)^{18}F$ nuclear reaction, $^{11}C$ using a gas for the production of $^{11}C$ via the $^{14}N(p,a)^{11}C$ reaction, or $^{68}Ga$ through a $^{68}Zn(p,n)^{68}Ga$ reaction in aqueous solution.

It should be understood, however, that embodiments are not required to generate $^{68}Ga$ isotopes. A variety of target materials may be used for generating other isotopes. By way of example, a radionuclide production system may generate protons to make $^{18}F^-$ isotopes in liquid form, $^{11}C$ isotopes as $CO_2$ or $CH_4$ from a gas target, and $^{13}N$ isotopes as $NH_3$ from a liquid target. The target material used to make these isotopes may be enriched [$^{18}O$]water, natural $N_2$ gas (which may include added $O_2$ or $H_2$), $^{nat}$water (may include dilute ethanol). The radionuclide production system may also generate protons or deuterons in order to produce $^{15}O$ gases (e.g. oxygen, carbon dioxide, and carbon monoxide) and [$^{15}O$]water.

In particular embodiments, the target material may be natural $N_2$ gas and the target foil may comprise a secondary layer that separates the nickel-based superalloy layer from the production chamber. For example, the secondary layer may comprise gold, niobium, tantalum, titanium, an alloy including one or more of the above, or another inert material for the intended application. The secondary layer may impede the flow of long-lived impurities from the nickel-based superalloy layer to the production chamber.

The target body has a beam passage that receives the particle beam and permits the particle beam to be incident upon the target material. The target body also includes a grid section, such as the grid section 238, disposed in the beam passage. The grid section 238 is configured to support a target foil. The target foil is exposed to the target material (e.g., liquid). Optionally, an additional grid section, such as the grid section 225, is disposed in the beam passage. A front foil (e.g., degrader foil) may be positioned between the two grid sections. Each of the first and second grid sections has front and back sides. The back side of the first grid section and the front side of the second grid section abut each other with an interface therebetween. The back side of the second grid section faces the production chamber.

In alternative embodiments, the target body does not include any grid section for supporting the target foil. In such embodiments, the pressure generated with the production chamber may be sufficiently low such that the target foil may withstand the pressure during isotope production. Alternative embodiments that do not utilize a grid section are described in U.S. Patent Application Publication No. 2011/0255646 and U.S. Patent Application Publication No. 2010/0283371, each of which are incorporated herein by reference in its entirety. Alternatively or in addition to the above, the nickel-based superalloy layer may have a designated thickness and/or tensile strength such that the target foil may withstand the pressure during isotope production. Alternatively or in addition to the above, an additional layer may be positioned to support the nickel-based superalloy layer. For example, a layer of Havar may be positioned behind the target foil such that the target foil is positioned between the production chamber and the layer of Havar during isotope production.

The method also includes directing, at 304, the particle beam onto the target material. In some embodiments, the isotope production system 100 uses technology and brings the charged particles to a designated energy with a designated beam current of approximately 10-30 μA. The particle beam passes through the optional front foil (e.g., degrader foil or foil) and through the target foil into the production chamber. In some embodiments, the front foil may reduce the energy of the particle beam by at least 10%. The energy of the particle beam that is incident upon the target material may be less than 24 MeV, less than 18 MeV, or less 8 MeV. The energy of the particle beam that is incident upon the target material may be between 7 MeV and 24 MeV. In particular embodiments, the energy of the particle beam that is incident upon the target material may be between 12 MeV and 18 MeV. In more particular embodiments, the energy of the particle beam that is incident upon the target material may be about 13 MeV to about 15 MeV. However, it should be understood that the energy of the particle beam may be greater than or less than the values described above. For example, the energy of the particle beam may be more than 24 MeV in some embodiments.

Optionally, the method also includes replacing an older target foil (or legacy foil), which does not include the nickel-based alloy composition, with a newer target foil such as the target foils described herein. For example, the method may further include replacing the legacy foil with the target foil having the material layer with the nickel-based superalloy composition and controlling operation of the cyclotron to increase a beam current. As described herein, embodiments may enable or allow increasing the beam current. An increased beam current may reduce a time period required for producing a designated amount of radionuclide and/or increase an amount of radionuclide that can be obtained within the time period.

Embodiments described herein are not intended to be limited to generating radionuclides for medical uses, but may also generate other isotopes and use other target materials. Also the various embodiments may be implemented in connection with different kinds of cyclotrons having different orientations (e.g., vertically or horizontally oriented), as well as different accelerators, such as linear accelerators or laser induced accelerators instead of spiral accelerators. Furthermore, embodiments described herein include methods of manufacturing the isotope production systems, target systems, and cyclotrons as described above.

Embodiments described herein are not intended to be limited to generating radionuclides for medical uses, but may also generate other isotopes and use other target materials. Also the various embodiments may be implemented in connection with different kinds of cyclotrons having different orientations (e.g., vertically or horizontally oriented), as well as different accelerators, such as linear accelerators or laser induced accelerators instead of spiral accelerators. Furthermore, embodiments described herein include methods of manufacturing the isotope production systems, target systems, and cyclotrons as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be stand-alone programs, may be incorporated as subroutines in an operating system, may be functions in an installed software package, or the like. The various embodiments are not limited to the arrangements and instrumentality shown in the drawings.

What is claimed is:

1. A target assembly for an isotope production system, the target assembly comprising:

a target body having a production chamber and a beam cavity that is adjacent to the production chamber, the production chamber configured to hold a target material, the beam cavity being configured to receive a particle beam that is incident on the production chamber; and a target foil positioned to separate the beam cavity and the production chamber, the target foil having a side that is exposed to the production chamber such that the target foil is in contact with the target material during isotope production, wherein the target foil includes a material layer having a nickel-based superalloy composition, wherein the nickel-based superalloy composition includes at least 40 wt % nickel and a sum of percent weights for aluminum and titanium is at most 10 wt %.

2. The target assembly of claim 1, wherein the nickel-based superalloy composition comprises nickel (75 wt %), cobalt (2 wt %), iron (3 wt %), chromium (16 wt %), molybdenum (0.5 wt %), tungsten (0.5 wt %), manganese (0.5 wt %), silicon (0.2 wt %), niobium (0.15 wt %), aluminum (4.5 wt %), titanium (0.5 wt %), carbon (0.04 wt %), boron (0.01 wt %), and zirconium (0.1 wt %).

3. The target assembly of claim 1, wherein the nickel-based superalloy composition includes at least one of cobalt having a percent weight between 10 wt % and 20 wt % or chromium having a percent weight between 10 wt % and 20 wt %.

4. The target assembly of claim 1, wherein the target foil includes a nickel-based superalloy layer and a secondary layer that is stacked with respect to the nickel-based superalloy layer, the secondary layer being positioned between the nickel-based superalloy layer and the production chamber and exposed to the production chamber such that the target material is in contact with the secondary layer during isotope production.

5. The target assembly of claim 4, wherein the secondary layer is configured to reduce chemical contaminants and long-lived radionuclides contaminants.

6. The target assembly of claim 1, wherein the target foil has a thickness that is between 10 and 50 micrometers.

7. The target assembly of claim 1, wherein the nickel-based superalloy composition includes at least 70 wt % nickel.

8. The target assembly of claim 7, wherein the nickel-based superalloy composition includes between 8 wt % and 20 wt % chromium and the sum of percent weights for aluminum and titanium is between 2.5 wt % and 6 wt %.

9. The target assembly of claim 8, wherein the nickel-based superalloy composition includes at most 3 wt % iron.

10. The target assembly of claim 1, wherein the nickel-based superalloy composition includes at least 50 wt % nickel, at least 8 wt % chromium, at most 5 wt % iron, and the sum of percent weights for aluminum and titanium is at most 8 wt %.

11. The target assembly of claim 1, wherein the nickel-based superalloy composition includes at least 55 wt % nickel, between 8 wt % and 20 wt % chromium, at most 3 wt % iron, and the sum of percent weights for aluminum and titanium is at most 6 wt %.

12. A method of generating radionuclides, the method comprising:

providing a target material into a production chamber of a target assembly, the target assembly having a production chamber and a beam cavity that is adjacent to the production chamber, the production chamber configured to hold a target fluid, the beam cavity configured to receive a particle beam that is incident on the production chamber, the target assembly also including a target foil positioned to separate the beam cavity and the production chamber, the target foil having a side that is exposed to the production chamber such that the target material is in contact with the target foil during isotope production, wherein the target foil includes a material layer having a nickel-based superalloy composition; and directing the particle beam onto the target material, the particle beam passing through the target foil to be incident on the target material, wherein a beam current of the system is at least 100 μA.

13. The method of claim 12, wherein the target material is a gas material for the production of $^{11}C$ via the $^{14}N(p,a)^{11}C$ reaction, the target foil being exposed to the gas material such that the gas material is in contact with the target foil during isotope production, wherein a side of the target foil that is in contact with the gas material has at most 0.17 wt % carbon.

14. The method of claim 12, wherein the nickel-based superalloy composition includes at least 40 wt % nickel and also comprises aluminum, titanium and at least one of cobalt or chromium, wherein a sum of percent weights of the aluminum and the titanium is at most 10 wt %, wherein the nickel-based superalloy composition also includes at least one of cobalt having a percent weight between 10 wt % and 20 wt % or chromium having a percent weight between 10 wt % and 20 wt %.

15. The method of claim 12, wherein the target foil is a legacy foil, the method further comprising replacing the legacy foil with the target foil having the material layer with the nickel-based superalloy composition and controlling operation of the cyclotron to increase a beam current.

16. The method of claim 12, wherein the target foil includes a nickel-based superalloy layer and a secondary layer that is stacked with respect to the nickel-based superalloy layer, the secondary layer being positioned between the nickel-based superalloy layer and the production chamber and exposed to the production chamber such that the target material is in contact with the secondary layer during isotope production.

17. The method of claim 16, wherein the secondary layer is configured to reduce chemical contaminants and long-lived radionuclides contaminants.

18. The method of claim 12, wherein the nickel-based superalloy composition includes at least 40 wt % nickel and a sum of percent weights for aluminum and titanium is at most 10 wt %.

19. The method of claim 12, wherein the nickel-based superalloy composition includes at least 70 wt % nickel, between 8 wt % and 20 wt % chromium, and at most 3 wt % iron.

20. A target assembly for an isotope production system, the target assembly comprising:

a target body having a production chamber and a beam cavity that is adjacent to the production chamber, the production chamber configured to hold a target material, the beam cavity being configured to receive a particle beam that is incident on the production chamber; and a target foil positioned to separate the beam cavity and the production chamber, the target foil having a side that is exposed to the production chamber such that the target foil is in contact with the target material during isotope production, wherein the target foil includes a material layer having a nickel-based superalloy composition;

wherein the target foil includes a nickel-based superalloy layer and a secondary layer that is stacked with respect to the nickel-based superalloy layer, the secondary layer being positioned between the nickel-based superalloy layer and the production chamber and exposed to the production chamber such that the target material is in contact with the secondary layer during isotope production, wherein the secondary layer comprises refractory or platinum-group metals or alloys thereof.

* * * * *